US007459420B2

(12) United States Patent
Vlahakis

(10) Patent No.: US 7,459,420 B2
(45) **Date of Patent: *Dec. 2, 2008**

(54) AUTOMATIC DISHWASHING DETERGENT COMPRISED OF ETHYLENE OXIDE ADDUCT AND WITHOUT PHOSPHATES

(76) Inventor: E. Van Vlahakis, 20 South Dr., Key Largo, FL (US) 33037

( * ) Notice: Subject to any disclaimer, the term of this patent is extended or adjusted under 35 U.S.C. 154(b) by 155 days.

This patent is subject to a terminal disclaimer.

(21) Appl. No.: 11/001,518

(22) Filed: Dec. 1, 2004

(65) Prior Publication Data

US 2006/0116307 A1 Jun. 1, 2006

(51) Int. Cl.
*C11D 1/72* (2006.01)
*C11D 1/74* (2006.01)
*C11D 1/29* (2006.01)

(52) U.S. Cl. ..... 510/220; 510/221; 510/224; 510/378; 510/421; 510/424

(58) Field of Classification Search ..... 510/220, 510/221, 224, 378, 421, 424
See application file for complete search history.

(56) References Cited

U.S. PATENT DOCUMENTS 3,029,205 A * 4/1962 Henderson et al. ..... 510/424
3,706,672 A * 12/1972 Martin et al. ..... 510/476
3,852,209 A * 12/1974 Hofmann ..... 510/227
3,941,710 A * 3/1976 Gilbert et al. ..... 510/220
3,997,576 A 12/1976 Oghoshi et al.
4,001,132 A * 1/1977 Maguire, Jr. ..... 510/228
4,072,632 A * 2/1978 Reed ..... 510/235
4,087,368 A * 5/1978 Borrello ..... 510/306
4,367,169 A 1/1983 Matsushita et al.
4,374,056 A 2/1983 Watanabe et al.
4,438,025 A 3/1984 Satsuki et al.
4,487,710 A 12/1984 Kaminsky
4,488,989 A 12/1984 Lamberti
4,597,898 A 7/1986 Vander Meer
4,705,644 A 11/1987 Barone et al.
4,919,845 A * 4/1990 Vogt et al. ..... 510/356
4,975,218 A * 12/1990 Rosser ..... 510/158
5,104,567 A 4/1992 Staehr
5,143,639 A 9/1992 Krawack
5,380,453 A 1/1995 Krawack
5,382,677 A 1/1995 Colignon et al.
5,391,783 A 2/1995 Colignon et al.
5,397,494 A 3/1995 Vega et al.
5,429,773 A 7/1995 Sherry et al.
5,475,134 A 12/1995 Baker
5,482,644 A 1/1996 Nguyen et al.
5,602,089 A 2/1997 Pennaz
5,616,781 A 4/1997 Sajic et al.
5,629,278 A * 5/1997 Baeck et al. ..... 510/236
5,637,560 A 6/1997 Raehse et al.
5,637,758 A 6/1997 Sajic et al.
5,688,982 A 11/1997 Khan et al.
5,707,955 A * 1/1998 Gomes et al. ..... 510/421
5,851,976 A 12/1998 Mertens
5,912,223 A * 6/1999 Drapier ..... 510/417
5,945,394 A 8/1999 Sajic et al.
5,955,413 A * 9/1999 Campagna et al. ..... 510/278
5,965,500 A 10/1999 Puvvada
5,968,885 A * 10/1999 Del Duca et al. ..... 510/375
5,968,893 A 10/1999 Manohar et al.
5,972,861 A 10/1999 Rolfes
6,008,181 A * 12/1999 Cripe et al. ..... 510/426
6,013,611 A 1/2000 Thomas et al.
RE36,593 E 2/2000 Emery
6,024,943 A * 2/2000 Ness et al. ..... 424/59
6,046,151 A 4/2000 Drapier et al.
6,057,280 A 5/2000 Huish et al.
6,060,440 A 5/2000 Sackariasen et al.
6,153,567 A * 11/2000 Hughes ..... 510/108
6,407,050 B1 6/2002 Huish et al.
6,468,956 B1 10/2002 Huish et al.
6,720,298 B2 * 4/2004 Blything et al. ..... 510/351
6,764,989 B1 7/2004 Huish et al.
6,774,096 B1 * 8/2004 Paye ..... 510/130
6,780,826 B2 * 8/2004 Zhang et al. ..... 510/130
6,794,349 B2 * 9/2004 Hafkamp et al. ..... 510/356
6,846,796 B2 * 1/2005 Schmid ..... 510/446
2003/0045191 A1 * 3/2003 Goldstein et al. ..... 442/96
2003/0139317 A1 * 7/2003 Behler et al. ..... 510/421
2003/0166488 A1 * 9/2003 Elsner et al. ..... 510/421
2003/0171247 A1 * 9/2003 Meine et al. ..... 510/504

FOREIGN PATENT DOCUMENTS

EP 0252695 A2 * 1/1988
EP 0 336 740 B1 1/1995
EP 0633307 A1 * 1/1995
WO WO 98/18892 A2 * 5/1998
WO WO 01/79414 A1 * 10/2001

* cited by examiner

*Primary Examiner*—Lorna M Douyon
(74) *Attorney, Agent, or Firm*—McDermott Will & Emery LLP

(57) ABSTRACT

The invention is an automatic dishwashing detergent composition, comprising an alkylene oxide, and being devoid of phosphates. Preferably, the alkylene oxide is an ethylene oxide. It is also preferable that the automatic dishwashing detergent be devoid of caustic soda and bleach. The detergent composition may be made from a component having between 20 and 60 moles of the ethylene oxide.

13 Claims, No Drawings

AUTOMATIC DISHWASHING DETERGENT COMPRISED OF ETHYLENE OXIDE ADDUCT AND WITHOUT PHOSPHATES

TECHNICAL FIELD

The invention is directed to automatic dishwashing detergents comprising alkylene oxides, and optionally made from oils derived from $C_{12}$-$C_{18}$-fatty acids. It is further directed to automatic dishwashing detergent compositions made from a component having between 20 and 60 moles of alkylene oxide, or between 20 and 60 moles of alkylene oxide per mole of $C_{12}$-$C_{18}$-fatty acids. The invention is directed to automatic dishwashing detergents that combine favorable characteristics, such as low foaming, high cleansing capabilities, and an environmentally friendly formulation.

BACKGROUND OF THE INVENTION

Automatic dishwashing detergents are well-known in the art. Most of the automatic dishwashing detergents currently available are suitable for their intended purposes, i.e., effectively cleaning, and leaving previously soiled eating and cooking utensils in a generally spot-free, clean condition.

Known automatic dishwashing detergents contain some combination of one or more of three ingredients, including bleach, caustic soda, and phosphates. These substances can be deleterious, for various reasons.

For example, phosphates are minerals that act as water softeners and are considered by some to be among the worst pollutants found in detergents. Phosphates are a nutrient, and act as a fertilizer for algae. Thus, when phosphates enter waterways, they promote the growth of algae and other plants. In the presence of large amounts of phosphates and other similar nutrients, excessive algae growth occurs. This causes odors and creates hypoxic conditions.

Some states have banned the use of phosphates in all detergents, other than automatic dishwasher detergents. Thus, phosphate-free general purpose detergents and clothing detergents are readily available.

Caustic soda is also considered to be a contaminant of groundwater. For example, alumina plants use and discharge caustic soda into the groundwater adjacent their plants, and such groundwater contamination is considered to be a significant environmental problem. Moreover, the caustic soda can impart to the automatic dishwashing detergent a noticeable odor, which can be described as a "choking-type" odor. Moreover, an etched film can be irreversibly formed on the surface of glassware that has been repeatedly washed with caustic soda-containing automatic dishwashing detergents.

Bleach provides automatic dishwashing detergents with some disinfecting capabilities. While bleach in groundwater is not generally deemed to be deleterious, the removal of bleach from an automatic dishwashing detergent would lower the cost of that dishwashing detergent. Bleach, especially when combined with caustic soda, can contribute to the choking-type odor that may be perceived in some other automatic dishwashing detergent products.

It would be desirable to provide an automatic dishwashing detergent which is free of phosphates. It would further be desirable to provide an automatic dishwashing detergent which is free of caustic soda. Finally, it would be desirable to provide an automatic dishwashing detergent which is free of bleach.

SUMMARY OF THE INVENTION

The invention is an automatic dishwashing detergent that includes alkylene oxides, and is free of phosphates, caustic soda, or bleach. The inventor has found that an automatic dishwashing detergent made from a product having from 20 to 60 moles of ethylene oxide is particularly effective in cleaning soiled eating and cooking utensils. Thus, preferably, the alkylene oxide is a ethylene oxide. One aspect of the invention is an automatic dishwashing detergent made from a raw material that includes an alkylene oxide, and particularly and ethylene oxide. Another aspect of the invention is an automatic dishwashing detergent that comprises an alkylene oxide, and particularly and ethylene oxide.

A further aspect of the invention is an automatic dishwashing detergent that is further devoid of caustic soda. A still further aspect of the invention is an automatic dishwashing detergent composition that is devoid of bleach.

The automatic dishwashing detergent may further include a thickener, a surfactant, a water softener, a fragrance, or a filler. Preferred fillers for the liquid version of the automatic dishwashing detergent include water, preferably deionized water. In contrast, sodium sulfate is the preferred filler for the dry or powdered version of the automatic dishwashing detergent of the invention. A preferred fragrance is lavender oil.

DETAILED DESCRIPTION OF PREFERRED EMBODIMENT

Preferred embodiments of the invention are described below. This invention may, however, be embodied in many different forms, and should not be construed as limited to the embodiments described below. Instead, these embodiments are provided so that this disclosure will fully convey the scope of the invention to those skilled in the art.

The examples below use Disponil FES 77 IS. Disponil FES 77 IS is available from Cognis Corporation, Coatings and Inks Division, Ambler, Pa. The Disponil FES 77 IS is a fatty alcohol ether sulfate, i.e., the sodium salt of a fatty alcohol ether sulfate, and in particular, an ethoxylated sodium lauryl ether sulfate. Disponil FES 77 IS includes thirty (30) moles of an ethylene oxide. It is believed that for each 30 moles of this ethylene oxide in Disponil FES 77 IS, there is also one mole of an oil based upon a $C_{12}$-$C_{18}$-fatty acid. The alkylene or ethylene oxide acts as the hydrophilic portion of the detergent, whereas the oil based upon a $C_{12}$-$C_{18}$-fatty acid acts as the lipophilic portion of the detergent.

As noted above, Disponil FES 77 IS is said to include thirty moles of ethylene oxide. The "sodium lauryl" portion of the Disponil FES 77 IS is believed to have been made using coconut oil. However, it is believed that in lieu of coconut oil, other oils, such as tallow oil, soybean oil, olive oil, and other similar oils may be used.

In order to create other dishwashing detergents within the scope of the invention, substitutions can be made for the Disponil FES 77 IS product. Particularly, one can substitute for the Disponil FES 77 IS a product having a greater or lesser amount of ethylene oxide.

As a second example, in lieu of the Disponil FES 77 IS product, one may use Disponil FES 61 IS sodium lauryl ether sulfate, having fifty (50) moles of ethylene oxide. In this case, it is believed that the ratio of alkylene oxide per mole of $C_{12}$-$C_{18}$-fatty acid is 50:1.

As a third example, in lieu of the Disponil FES 77 IS product, one may use a product having up to sixty (60) moles of ethylene oxide. In this case, it is believed that the ratio of alkylene oxide per mole of $C_{12}$-$C_{18}$-fatty acid is 60:1.

As a fourth example, in lieu of the Disponil FES 77 IS product, one may use a product having about twenty (20) moles of ethylene oxide. In this case, it is believed that the ratio of alkylene oxide per mole of $C_{12}$-$C_{18}$-fatty acid is 20:1.

Products similar to Disponil FES 77 IS, but having greater or lesser amounts of ethylene oxide, are also available from Cognis Corporation, Coatings and Inks Division, Ambler, Pa.

As noted above, twenty to sixty moles of ethylene oxide are to be either included in the automatic dishwashing detergent of the invention. Alternatively, a component of the automatic dishwashing detergent in accordance with the invention includes twenty to sixty moles of ethylene oxide. If significantly smaller amounts of the ethylene oxide are used, the resulting automatic dishwashing detergent product may foam excessively during use in automatic dishwashing, as compared to the product made in accordance with the invention. If significantly greater amounts of the ethylene oxide are used, the resulting automatic dishwashing detergent product may not clean as effectively as product made in accordance with the invention.

The below described examples show an automatic dishwashing detergent in a liquid or powder form. Alternatively, a preferred automatic dishwashing detergent composition in accordance with the invention may have between 20 moles of alkylene oxide and 60 moles of alkylene oxide, per mole of $C_{12}$-$C_{18}$-fatty acid. A most preferred automatic dishwashing detergent composition in accordance with the invention is made from a raw material having between 20 and 60 moles of ethylene oxide; or from a raw material having between 20 and 60 moles of ethylene oxide per mole of coconut- or other oil-derived $C_{12}$-$C_{18}$-fatty acids.

The automatic dishwasher detergent may include preservatives. The most preferred preservative is Surcide P (hexahydro-1,3,5,-tris(2-hydroxyethyl)-s-triazine). Another suitable preservative is bronopol (2-nitro-2-bromo-1,3-propanediol). Any number of other well-known detergent preservatives may be used, as well.

In the present automatic dishwashing detergents, the Disponil FES 77 IS, and the Dehypon LS-54, also both act as surfactants. Disponil FES 77 IS is preferably present in the novel automatic dishwashing detergent composition in an amount of between 3% and 6% by weight.

Dehypon LS-54 is available from Cognis (Canada) Corporation, of Mississauga, Ontario, Canada. Dehypon LS-54 is preferably present in the novel automatic dishwashing detergent composition in an amount of between 1% and 5% by weight. Dehypon LS-54 is believed to include five (5) moles of ethylene oxide, and four (4) moles of propylene oxide. Dehypon LS-54 is also believed to contain an organic $C_{12}$-$C_{14}$-component.

The Disponil FES 77 IS and the Dehypon LS-54 serve to clean and disperse the soil on utensils in the dishwasher. The propylene oxide portion of the Dehypon LS 54 is also believed to be especially effective in reducing the amount of foam created by the automatic dishwashing detergent, during use in the dishwashing cycle.

Xanthan gum can be used as a thickener, especially in the liquid versions of the automatic dishwashing detergent.

Corn starch may be added to either the liquid or dry, powdered forms of the automatic dishwashing detergent of the invention. Corn starch has a chemical structure that is similar to the structure of starch-based food products. Because of this similarity, corn starch is especially helpful in the cleaning of such starch-based food products. The corn starch also acts as a builder, and provides "body" to the automatic dishwashing detergent.

Fillers are necessary for both the liquid and solid, powdered versions of the automatic dishwashing detergents of the invention. The fillers are inactive or inert components of the automatic dishwashing detergents. In the liquid version of the automatic dishwashing detergent of the invention, water is the preferred filler, and deionized water is the most preferred filler. In the solid, powdered version of the automatic dishwashing detergents of the invention, sodium sulfate is the preferred filler.

Water softeners are also generally added, especially in the solid, powdered version of the automatic dishwashing detergent. Sodium citrate is a preferred water softener for the automatic dishwashing detergent of the invention.

In order to give the dishwashing detergent a pleasing scent, a fragrance is often added. The fragrance provides the automatic dishwashing detergent with aesthetically pleasing characteristics. Lavender oil is a preferred fragrance for use with the dishwashing detergent in accordance with the invention.

As indicated above, the automatic dishwashing detergent of the invention is devoid of bleach. An advantage of the inclusion of bleach in prior art automatic dishwashing detergents is that that bleach removes stains, such as coffee stains that can form on porcelain or clay coffee cups. In order to remove stains from such porcelain or clay cups or utensils that are treated with the present automatic dishwashing detergent, one may optionally add sodium perborate during an occasional dishwashing cycle. Particularly, the user should add one-half (½) ounce to one (1) ounce of sodium perborate to the amount of the powdered dishwashing detergent, such as the detergent of Example 2, used in one dishwashing cycle, prior to the start of a dishwashing cycle, every fourteen (14) to thirty (30) days.

Alternatively, as shown in Example 3, the sodium perborate may be an integral part of the dry, powdered detergent composition of the invention.

Sodium perborate has the chemical formula $NaBO_3$, and can be used in its anhydrous form (as shown in the preceding formula), or in one of its several hydrated forms.

The following Examples are preferred, but not limiting, embodiments of the invention:

EXAMPLE 1

One preferred example of a liquid form of a dishwashing detergent in accordance with the invention is described below. The liquid dishwashing detergent of this preferred embodiment is made by blending together three separate phases. In the present example, a one-hundred pound batch is manufactured.

Phase 1 comprises deionized water and sodium citrate dihydrate. In this example, Phase 1 is made by blending 7.00 pounds of sodium citrate dihydrate USP to 39.55 pounds of deionized water. These components are mixed until the sodium citrate is completely dissolved in the water.

Phase 2 comprises three ingredients. Three (3.00) pounds of Disponsil FES 77 18, 0.75 pounds of xanthan gum (food grade), and 1.00 pound of Dihypon LS-54 are blended together. These three ingredients are mixed thoroughly, until all of the xanthan gum is dissolved.

After Phase 2 is properly blended as described above, Phase 2 is added to Phase 1, with agitation. Phase 1 and Phase 2 are agitated until the mix has a uniform appearance.

Phase 3 is a combination of 45.45 pounds of deionized water, 3.00 pounds of corn starch, 0.05 pound of lavender oil, and 0.200 pounds of Surcide P. All four of the ingredients of Phase 3 are combined, and then blended until the corn starch is completely dissolved.

After Phase 3 is properly blended as described above, Phase 3 is added to the combined Phase 1/Phase 2, with agitation. All three Phases are now mixed, until the entire batch has a uniform appearance.

EXAMPLE 2

Described in this second example is a preferred example of a powdered form of a dishwashing detergent in accordance with the invention. This preferred, powdered form of the dishwashing detergent of the invention is made by blending together five different components. Three of the components are solids, and two of the components are liquids.

First, the three solid components are blended. Particularly, to manufacture a one-hundred (100) pound batch of the powdered dishwashing detergent in accordance with the invention, eight (8) pounds of sodium citrate, four (4) pounds of corn starch, and eighty-two (82) pounds of sodium sulfate are mixed thoroughly, until the mixture achieves a uniform appearance and consistency.

After the three solid components have achieved this uniform appearance and consistency to achieve a dry mix, the two liquid components are slowly added to this dry mix. The first liquid component added is five (5) pounds of Disponil FES 77 IS. The second liquid component added is one (1) pound of Dehypon LS-54. The liquid components are added slowly, so as to ensure that the liquids are completely absorbed by the three solid components.

EXAMPLE 3

Described in this third example is yet another example of a powdered form of a dishwashing detergent in accordance with the invention. This preferred, powdered form of the dishwashing detergent of the invention is made by blending together six different components. Four of the components are solids, and two of the components are liquids.

First, the four solid components are blended. Particularly, to manufacture a one-hundred (100) pound batch of the powdered dishwashing detergent in accordance with the invention, eight (8) pounds of sodium citrate, four (4) pounds of corn starch, seventy-seven (77) pounds of sodium sulfate, and five (5) pounds of sodium perborate are mixed thoroughly, until the mixture achieves a uniform appearance and consistency.

After the four solid components have achieved this uniform appearance and consistency to achieve a dry mix, the two liquid components are slowly added to this dry mix. The first liquid component added is five (5) pounds of Disponil FES 77 IS. The second liquid component added is one (1) pound of Dehypon LS-54. The liquid components are added slowly, so as to ensure that the liquids are completely absorbed by the four solid components.

What is claimed is:

1. A low-foaming automatic dishwashing composition consisting of between 3 wt. % and 6 wt. % of a first detergent having between 20 and 60 moles of alkylene oxide; between 1 wt. % and 5 wt. % of a second detergent having a propylene oxide adduct; a filler; and optionally, at least one of a thickener, a water softener, and a fragrance, said automatic dishwashing composition being devoid of phosphates.

2. The automatic dishwashing composition of claim 1, wherein said alkylene oxide is an ethylene oxide.

3. The automatic dishwashing composition of claim 1, wherein the thickener is present in the automatic dishwashing composition.

4. The automatic dishwashing composition of claim 1, wherein the water softener is present in the automatic dishwashing composition.

5. The automatic dishwashing composition of claim 1, wherein the fragrance is present in the automatic dishwashing composition.

6. The automatic dishwashing composition of claim 1, wherein said filler is water.

7. The automatic dishwashing composition of claim 1, wherein said filler is sodium sulfate.

8. The automatic dishwashing composition of claim 5, wherein said fragrance is lavender oil.

9. The automatic dishwashing composition of claim 1 wherein said first detergent has 30 moles of ethylene oxide.

10. A low-foaming automatic dishwashing composition consisting of between 3 wt. % and 6 wt. % of a first detergent having a $C_{12}$-$C_{18}$ fatty acid and between 20 and 60 moles of alkylene oxide; between 1 wt. % and 5 wt. % of a second detergent having a propylene oxide adduct; a filler; and optionally, at least one of a thickener, a water softener, and a fragrance, said automatic dishwashing composition being devoid of phosphates.

11. The automatic dishwashing composition of claim 10, wherein said alkylene oxide is an ethylene oxide.

12. The automatic dishwashing composition of claim 10 wherein said first detergent has 30 moles of ethylene oxide.

13. A low-foaming automatic dishwashing composition consisting of between 3 wt. % and 6 wt. % of a first detergent having a $C_{12}$-$C_{18}$ fatty acid and between 20 and 60 moles of alkylene oxide; between 1 wt. % and 5 wt. % of a second detergent having a propylene oxide adduct; a filler; sodium perborate; and optionally, at least one of a thickener, a water softener, and a fragrance, said automatic dishwashing composition being devoid of phosphates.

* * * * *